US007078365B2

(12) United States Patent
Kajikawa et al.

(10) Patent No.: US 7,078,365 B2
(45) Date of Patent: Jul. 18, 2006

(54) THERMOSENSITIVE RECORDING MATERIAL

(75) Inventors: Takeshi Kajikawa, Sunto-gun (JP); Toshiaki Ikeda, Sunto-gun (JP); Mitsuru Naruse, Tagata-gun (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 10/788,262

(22) Filed: Mar. 1, 2004

(65) Prior Publication Data

US 2004/0171487 A1 Sep. 2, 2004

(30) Foreign Application Priority Data

Feb. 28, 2003 (JP) ..... 2003-052417
Dec. 12, 2003 (JP) ..... 2003-415118

(51) Int. Cl.
*B41M 5/30* (2006.01)

(52) U.S. Cl. ..... 503/209; 503/200; 503/204; 503/216; 503/217; 503/221

(58) Field of Classification Search ..... 503/200, 503/204, 209, 216, 217, 221
See application file for complete search history.

(56) References Cited

U.S. PATENT DOCUMENTS

| | | | |
|---|---|---|---|
| 5,409,881 | A | 4/1995 | Mori et al. |
| 5,827,590 | A | 10/1998 | Morita et al. |
| 5,919,729 | A | 7/1999 | Mori et al. |
| 5,972,836 | A | 10/1999 | Morita et al. |
| 6,060,427 | A | 5/2000 | Mori et al. |
| 6,593,272 | B1 | 7/2003 | Kakuda et al. |
| 2002/0010095 | A1 | 1/2002 | Yamada et al. |
| 2002/0064613 | A1 | 5/2002 | Kugo et al. |
| 2003/0039917 | A1 | 2/2003 | Naruse et al. |
| 2003/0060366 | A1 | 3/2003 | Kaneko et al. |
| 2003/0125205 | A1 | 7/2003 | Kaneko et al. |
| 2003/0153460 | A1 | 8/2003 | Morita et al. |
| 2003/0175507 | A1 | 9/2003 | Ikeda et al. |

FOREIGN PATENT DOCUMENTS

| | | |
|---|---|---|
| DE | 100 12 850 A 1 | 9/2000 |
| EP | 0 999 072 A 1 | 5/2000 |
| EP | 2000135868 | 5/2000 |
| EP | 2002211141 | 7/2002 |
| JP | 08-333329 | 12/1996 |
| JP | 10-297089 | 11/1998 |
| JP | 10-297090 | 11/1998 |
| JP | 2000-135867 | 5/2000 |
| JP | 2000-143611 | 5/2000 |
| JP | 2001-310561 | 11/2001 |
| WO | WO99/51444 | 10/1999 |

*Primary Examiner*—B. Hamilton Hess
(74) *Attorney, Agent, or Firm*—Oblon, Spivak, McClelland, Maier & Neustadt, P.C.

(57) ABSTRACT

A thermosensitive recording material is provided having improved resistance to heat and chemicals, and having improved sensitivity to image formation while minimizing background coloring, wherein the thermosensitive recording material has a substrate, on which is a thermosensitive recording layer containing a leuco dye, a developer of formula (I) and at least two sensitizers, the two sensitizers being 4-hydroxy-4'-allyloxy diphenylsulfone and 4,4'-diallyloxy diphenylsulfone.

15 Claims, No Drawings

THERMOSENSITIVE RECORDING MATERIAL

BACKGROUND OF THE INVENTION

1. Field of Invention

The present invention relates to a thermosensitive recording material, and more particularly to a thermosensitive recording material capable of producing images with excellent preservation stability and/or improved chemical resistance to plasticizers or materials containing fats or oils.

2. Discussion of the Background

With diversification of information and expansion of needs therefor in recent years, various types of recording materials have been developed and put into practice in the field of information recording. Thermosensitive recording materials are widely used in various fields such as information processing (output of desk-top calculators, computers or the like), recorders for medical measurement devices, low- or high-speed facsimiles, automatic ticket machines (railway tickets, admission tickets or the like), thermal copying machines, labels of a POS (point of sales) system, and luggage tags because of the following advantages:

The thermosensitive recording materials have been used for applications in which reliability of images is required, such as POS systems and goods such as boxed lunches and daily dishes.

For example, the recording materials have been used for applications in which the recording materials are required to have good preservation stability to plasticizers and materials containing oils and fats; and applications in which the recording materials are required to have storage stability for several years.

The level of the requirements for the thermosensitive recording materials becomes higher and higher year by year. Therefore, attempts have been made to provide combinations of components including color developers and additives such as preservation stabilizers, to meet these challenges. However, materials having a well-balanced combination of coloring sensitivity and image preservation stability have not yet been developed.

Compounds of high molecular weight have been proposed for use as developer to particularly provide high preservation stability against plasticizers and materials containing fats and/or oils. The following compounds are examples of such developers: High molecular weight compounds based on diphenylsulfone derivatives (Japanese Laid-Open Patent Publication No. H08-333329); (poly) 4-hydroxybenzoic acid derivatives (WO99/51444); and Urea urethane compounds of high molecular weight (Japanese Laid-Open Patent Publication No.2000-143611).

As for these developers, preservation stability is high against plasticizers and materials containing fats and/or oils. However, they have the problem that coloring sensitivity is low. For example, the combination of a color developer of high molecular weight based on diphenylsulfone derivatives and a sensitizer of low melting point has been proposed in order to supplement coloring sensitivity. (Japanese Laid-Open Patent Publication No. H10-297089 and Japanese Laid-Open Patent Publication No. H10-297090)

These compositions attempt to give improved image recording density in low energy regions of the recording material by using the combination of a developer and a sensitizer having a low melting point. While coloring sensitivity of the top layer of the recording material is improved, there is found to be a significant drop in the image density due to decreased chemical resistance, such as to plasticizers. This shows the difficulty in obtaining both improved coloring sensitivity and improved image preservation and chemical resistance when using a color developer of high molecular weight.

Another problem that occurs upon improving coloring sensitivity is that background coloring begins to occur at lower temperatures. One solution that has been proposed is the use of a diphenylsulfone crosslinking type compound as a color developer, combined with an aromatic compound having an aminosulfonyl group ($—SO_2NH_2$) as sensitizer. (Japanese Laid-Open Patent Publication No. 2001-135867). However, while enough sensitivity was provided, the increased sensitivity was not compatible with improved heat resistance.

Another approach that has been suggested in order to solve these problems is to prevent coloring of a background while having improved sensitivity by using a combination of a low molecular weight color developer along with 4-hydroxy-4'-allyloxy diphenylsulfone as sensitizer, to provide heat resistance and sensitivity and chemical resistance (Japanese Laid-Open Patent Publication No. 2001-310561).

In addition, an approach has been proposed using an emulsification technique to provide a dispersion, with dispersion control of a leuco dye for using thermal energy from a thermal head. A heat insulation effect is provided by use of an undercoat layer including submicron sized hollow particles. However, sensitivity is not sufficient and background coloring occurs.

SUMMARY OF THE INVENTION

Accordingly, one object of the present invention is to provide a thermosensitive recording material having improved chemical resistance, particularly with respect to plasticizers and/or materials containing fats or oils.

Another object of the present invention is to provide a thermosensitive recording material having high coloring sensitivity, while avoiding creation of unacceptable levels of background coloring.

A further object of the present invention is to provide a thermosensitive recording material having improved heat resistance.

These and other objects of the present invention are satisfied, either individually or in combination, by the discovery of a thermosensitive recording material, comprising a substrate and a thermosensitive recording layer on said substrate, the thermosensitive recording layer comprising a leuco dye, at least two sensitizers and a color developer for inducing color formation in the leuco dye upon application of heat thereto, wherein the at least two sensitizers comprise 4-hydroxy-4'-allyloxy diphenylsulfone and 4,4'-diallyloxy diphenylsulfone, and wherein the color developer is at least one member selected from the group consisting of diphenylsulfone derivatives represented by the following formula (I)

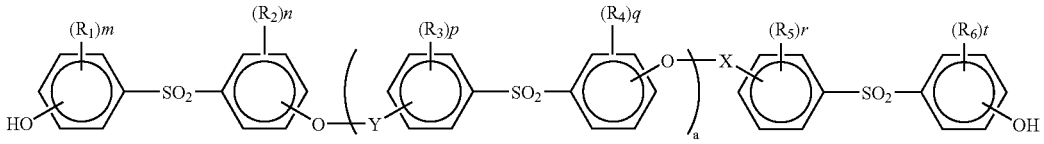

wherein, X and Y are each, independently, a saturated or unsaturated linear or branched hydrocarbon group having 1–12 carbon atoms, which can optionally possess an ether bond, or a group of formula II or III

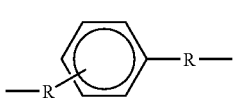

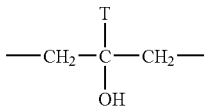

wherein, R7 indicates a methylene group or an ethylene group,

T indicates a hydrogen atom or an alkyl group having 1–4 carbon atoms,

R1–R6 each, independently, indicate a halogen atom, an alkyl group having 1-6 carbon atoms, or an alkenyl group having 2–6 carbon atoms, each of m, n, p, q, r, and t independently indicate an integer of from 0 to 4, and a is an integer of from 0 to 10.

DETAILED DESCRIPTION OF THE PREFERRED EMBODIMENTS

The present invention relates to a thermosensitive recording material, comprising a substrate and a thermosensitive recording layer on said substrate, the thermosensitive recording layer comprising a leuco dye, at least two sensitizers and a color developer for inducing color formation in the leuco dye upon application of heat thereto, wherein the at least two sensitizers comprise 4-hydroxy-4'-allyloxy diphenylsulfone and 4,4'-diallyloxy diphenylsulfone, and wherein the color developer is at least one member selected from the group consisting of diphenylsulfone derivatives represented by the following formula (I)

wherein, X and Y are each, independently, a saturated or unsaturated linear or branched hydrocarbon group having 1–12 carbon atoms, which can optionally possess an ether bond, or a group of formula II or III

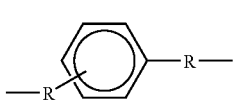

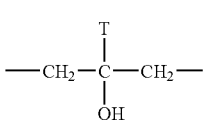

wherein, R7 indicates a methylene group or an ethylene group,

T indicates a hydrogen atom or an alkyl group having 1–4 carbon atoms,

R1–R6 each, independently, indicate a halogen atom, an alkyl group having 1–6 carbon atoms, or an alkenyl group having 2–6 carbon atoms, each of m, n, p, q, r, and t independently indicate an integer of from 0 to 4, and a is an integer of from 0 to 10.

The present invention provides a thermosensitive recording material that is superior in heat resistance and high image formation sensitivity, while avoiding the formation of color of the background, and can achieve a solution to the problem of balancing these properties simultaneously.

In the present invention, the ratio that of image retention by the thermosensitive recording material (the image preservation factor), is increased to be preferably greater than 80%, more preferably greater than 90%, even more preferably to be as close to 100% as possible.

Previously, there was the problem that a drop of the image preservation factor would occur (presumably due to poor chemical resistance) (falling to around 60% to 80%), when attempts were made to create high heat resistance and high sensitivity materials giving high recording density, while avoiding background coloring.

The thermosensitive recording material of the present invention may further comprise one or more additional

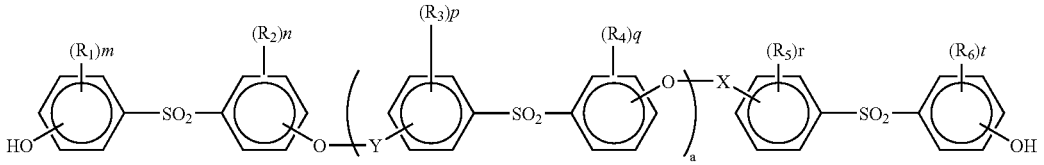

layers, such as an intermediate layer between the substrate and the thermosensitive recording layer, a printing layer on the thermosensitive recording layer, and an adhesive layer on the backside of the substrate (the side opposite the thermosensitive recording layer).

The thermosensitive recording material can further comprise an information memory means, including but not limited to a magnetic recording layer which can be located either on or at least partially within the thermosensitive recording material.

The thermosensitive recording material can take any desired form. Preferred uses for the material include, but are not limited to, use as a ticket or as a point card.

While the reasons that the present invention provides the desired combination of properties is not known, it is believed that the combination of properties is improved due to the improved compatibility of the developer of formula (I) with the two diphenylsulfone based sensitizers.

The present invention provides a system comprising a leuco dye and a developer of formula (I), with a sensitizer that contains 4-hydroxy-4'-allyloxy diphenylsulfone as primary sensitizer component, which is doped with a small amount (relative to the primary sensitizer component) of 4,4'-diallyloxy diphenylsulfone.

While the amount of 4,4'-diallyloxy diphenylsulfone is not particularly critical, it is preferred that 4,4'-diallyloxy diphenylsulfone be present in an amount of from 0.5–10 parts by weight, more preferably from 0.5–5 part by weight, and particularly preferably from 0.5–1 part by weight, relative to 100 parts by weight of 4-hydroxy-4'-allyloxy diphenylsulfone.

When 4,4'-diallyloxy diphenylsulfone is present in more than 10 parts by weight, there is an improvement in sensitivity. However, at those levels a decrease in image preservation factor ratio begins to appear, as does decreasing chemical resistance to plasticizers. When the 4,4'-diallyloxy diphenylsulfone is present in an amount less than 0.5 part by weight, compatibility and background coloring prevention decrease.

The combination of the diphenylsulfone sensitizers can be prepared by any desired method, including, but not limited to, mixing 4,4'-diallyloxy diphenylsulfone and 4-hydroxy-4'-allyloxy diphenylsulfone in the desired ratio or by generating the desired amount of 4,4'-diallyloxy diphenylsulfone in-situ as a product of the synthesis of 4-hydroxy-4'-allyloxy diphenylsulfone.

The amount of 4-hydroxy-4'-allyloxy diphenylsulfone and developer of formula (I) in the composition is preferably 2 to 7 parts by weight for each, more preferably 3 to 5 parts by weight for each, relative to 1 part by weight of leuco dye. In addition, the weight ratio of 4-hydroxy-4'-allyloxy diphenylsulfone and developer of formula (I) is preferably from 7:3 to 3:7, more preferably from 6:4 to 4:6. When 4-hydroxy-4'-allyloxy diphenylsulfone is used in an amount that is less than 30% of the amount of developer, the coloring ability becomes insufficient. In addition, when the developer of formula (I) is used in amounts greater than 70%, the effect of preservation stability improvement becomes insufficient.

The color developer of the present invention is at least one diphenylsulfone derivative represented by the general formula (I)

(I)

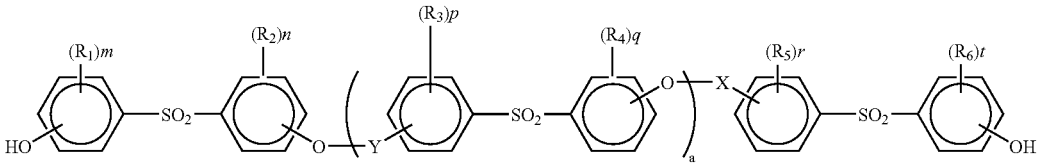

Wherein, X and Y are each, independently, a saturated or unsaturated linear or branched hydrocarbon group having from 1 to 12 carbon atoms, which may optionally contain an ether bond, or indicates a group of formulae (II) or (III)

(II)

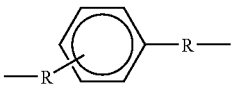

(III)

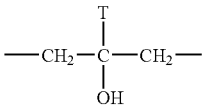

wherein, R7 indicates a methylene group or an ethylene group,

T indicates a hydrogen atom or an alkyl group having 1–4 carbon atoms,

R1–R6 each, independently, indicate a halogen atom, an alkyl group having 1–6 carbon atoms, or an alkenyl group having 2–6 carbon atoms, each of m, n, p, q, r, and t independently indicate an integer of from 0 to 4, and a is an integer of from 0 to 10.

Preferably X and Y are the same saturated branched hydrocarbon group having from 1 to 12 carbon atoms and possessing an ether bond in the hydrocarbon chain, more preferably X and Y are the same saturated branched hydrocarbon group having from 1 to 6 carbon atoms and containing an ether bond in the hydrocarbon chain, most preferably X and Y are each —$CH_2CH_2OCH_2$.

In the developer, preferably R is hydrogen, preferably T is hydrogen or an alkyl group having from 1 to 4 carbon atoms, more preferably T is hydrogen.

Further, preferably R1–R6 are each, independently, hydrogen or halogen atom or an alkyl group having from 1 to 4 carbon atoms or an alkenyl group having from 2–4 carbon atoms. Most preferably R1–R6 are each, independently, an alkyl group having from 1 to 3 carbon atoms. Preferably m, n, p, q, r, t indicate an integer from 0 to 4, more preferably m, n, p, q, r, t indicate an integer of 0 or 1. Preferably a is an integer of from 0 to 10, more preferably an integer of from 0 to 7.

A preferred diphenylsulfone derivative having general formula (I) is a composition sold under the tradename "D-90" (commercially available from Nippon Soda Co., Ltd.).

As the leuco dye of the present invention, which may be employed alone or in combinations of two or more, any conventional leuco dyes for use in leuco dye containing recording materials can be employed. Suitable preferred examples of leuco dyes include, but are not limited to, triphenylmethane type leuco dyes, fluoran type leuco dyes, phenothiazine type leuco dyes, auramine type leuco dyes, spiropyran type leuco dyes, indorinophthalide type leuco dyes are preferably employed. Specific more preferred examples of leuco dyes include, but are not limited to:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl) phthalide,
3-cyclohexylamino-6-chloro fluorane
3-dimethylamino-5,7-dimethyl fluorane,
3-N-methyl-N-isobuthyl-6-methyl-7-anilino fluorane,
3-N-ethyl-N-isoamyl-6-methyl-7-anilino fluorane,
3-diethylamino-7-chlorofluorane,
3-diethylamino-7-methylfluorane,
3-diethylamino-7,8-benzfluorane,
3-diethylamino-6-methyl-7-chlorofluorane,
3-(N-p-tolyl-N-ethylamino)-6-methyl-7-anilinofluorane,
3-pyrrolidino-6-methyl-7-anilinofluorane,
2-{N-(3-trifluoromethyl-phenyl)amino}-1,6-diethylaminofluorane,
2-{3,6-bis(diethylamino)-9-(o-chloroanilino)xanthylbenzoic acid lactam}
3-diethylamino-6-methyl-7-(m-trichloromethyl-anilino) fluorane,
3-diethylamino-7-(o-chloroanilino)fluorane,
3-dibutylamino-7-(o-chloroanilino)fluorane,
3-N-cmethyl-N-amylamino-6-methyl-7-anilinofluorane,
3-N-methyl-N-cyclohexylamino-6-methyl-7-anilinofluorane,
3-diethylamino-6-methyl-7-anilinofluorane,
3-diethylamino-6-methyl-7-(2',4'-dimethylanilino)fluorane,
3-(N,N-diethylamino)-5-methyl-7-(N,N-dibenzylamino-) fluorane,
benzoyl leuco methylene blue,
6'-chloro-8'-methoxy-benzoindolino-spyropyran,
6'-bromo-3'-methoxy-benzoindolino-spyropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methyl-phenyl)phthalide,
3-(2'-methoxy-4'-dimethyl-aminophenyl)-3-(2'-hydroxy-4'-chloro-5'-methyl-amino-phenyl)phthalide,
3-(N-morphorino-7-(N-propyl-trifluoromethylanilino)fluorane,
3-pyrrolidino-7-trifluoromethyl-anilinofluorane,
3-diethylamino-5-chloro-7-(N-benziltrifluoromethyl-anilino)fluorane,
3-pyrrolidino-7-(di-p-chlorophenyl)methylaminofluorane
3-diethylamino-5-chloro-7-(α-phenylethylamino)fluorane,
3-(N-ethyl-p-toluidino)-7-(α-phenylethylamino)fluorane,
3-diethylamino-7-(o-methoxycarbonylphenylamino)fluorane,
3-diethylamino-5-methyl-7-(α-phenylethylamino)fluorane,
3-diethylamino-7-piperidinofluorane,
2-chloro-3-(N-methyltoluidino)-7-(p-n-butylanilino)fluorane,
3-(N-methyl-N-isopropylamino-)-6-methyl-7-anilinofluorane,
3-dibutylamino-6-methyl-7-anilinofluorane,
3-diethylamino-6-ethyl-7-(3-methylanilino)fluorane,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluorane,
3-diethylamino-6-chloro-7-anilinofluorane,
3-N-ethyl-N-(2-ethoxypropyl)amino-6-methyl-7-anilinofluorane,
3-N-ethyl-N-tetrahydrofurfurylamino-6-methyl-7-anilinofluorane,
3-diethylamino-6-methyl-7-mesidino-4',5'-benzofluorane,
3-(p-dimethylaminophenyl)-3-{1,1-bis(p-dimethylaminophenyl)ethylene-2-yl}phthalide,
3-(p-dimethylaminophenyl)-3-{1,1-bis(p-dimethylaminophenyl)ethylene-2-yl}-6-dimethylamino-phthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6-dimethylaminophthalide,
3-(4'-dimethylamino-2'-methoxy)-3-(1"-p-dimethylaminophenyl-1"-p-chlorophenyl-1", 3"-butadiene-4"-yl)benzophthalide,
3-(4'-dimethyl-amino-2'-benzyloxy)-3-(1"-p-dimethyl-amino-phenyl-1"-phenyl-1", 3"-butadiene)-ylbenzophthalide,
3-dimethylamino-6-dimethylaminofluorene-9-spiro-3'(6'-dimethyl-amino-)phthalide,
3,3-bis12-(p-dimethylaminophenyl)-2-(p-methoxyphenyl) ethenyl1–4,5,6,7-tetrachloro phthalide,
3-bis {1,1-bis(4-pyrrolidinophenyl)ethylene-2-yl}-5,6-dichloro-4,7-dibromophthalide,
bis(p-dimethylaminostyryl)-1-naphthalenesulfonylmethane, or
bis(p-dimethylaminostyryl)-4-p-tolylsulfonylmethane.

A primary desired effect of the present invention is to provide superior chemical resistance of the formed image, and in particular, resistance with respect to plasticizers. A secondary effect is to provide high image forming sensitivity along with high heat resistance with minimal coloring of the background. Specific most preferable examples of leuco dyes for these purposes are as follows:

3-dibutylamino-6-methyl-7-anilinofluorane,
3-di(n-pentyl)amino-6-methyl-7-anilinofluorane, and
3-(N-ethyl-N-p-toluidino)-6-methyl-7-anilinofluorane.

Further, sensitivity can be enhanced by preferably using leuco dyes having average particle diameters of less than or equal to 1.0 μm, more preferably with average particle diameters of less than or equal to 0.3 μm. However, background coloring begins to occur when the diameter of the particles of leuco dye become too small (typically less than 0.1 μm. Accordingly, it is more preferable to use leuco dyes having average particle diameters from 0.1 μm to 0.3 μm, most preferably from 0.15 to 0.2 μm.

Preferably when the average particle diameter of the leuco dye is equal to or less than 0.3 μm, a surfactant is added in an amount of from 5 to 20% by weight relative to amount of leuco dye. The small particle diameter leuco dyes can be prepared using any conventional method, including, but not limited to a ball mill, an attritor, a sand mill, or a high pressure jet mill. In particular, methods of preparing the small particle diameter leuco dye, preferably containing surfactant, more preferably use a conventional carrier medium for leuco dyes, such as zirconia. In particular the medium is preferably zirconia, either of unimodal or bimodal particle diameter distribution. The particle diameter can be (1) less than or equal to 0.5 mm or (2) from 0.5 mm to 1.0 mm, or more preferably in a combination of both (1) and (2) in a bimodal distribution.

Average particle diameters for the component particles of the present invention can be measured using conventional methods, such as laser analysis scattering (LA920 type made in micro-motor lorry HRA9320-X100 type Horiba, Ltd., Lasentec FBRM apparatus), or by measurement machines such as centrifugal settling mode, Coulter counter, or electron microscope.

The present invention material can further contain other conventional auxiliary additives as desired. Suitable examples of such additives include, but are not limited to, hindered phenol compounds and hindered amine compounds. Specific examples of such additives include:

2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol),
tetrabromobisphenol A,
tetrabromobisphenol S,
4,4'-thiobis(2-methylphenol),
4,4'-thiobis(2-chlorophenol),
tetrakis(1,2,2,6,6-pentamethyl-4-piperidyl)-1,2,3,4-butanetetracarboxylate, and
tetrakis(1,2,2,6,6-tetramethyl-4-piperidyl)-1,2,3,4-butanetetracarboxylate.

To obtain a thermosensitive recording material according to the present invention, a variety of conventional binder agents can also be employed in the thermosensitive recording layer for binding the above-mentioned lueco dye, color developers, and auxiliary components. Specific examples of binder agents include, but are not limited to:

Water-soluble polymers such as
polyvinyl alcohol,
starch and starch derivatives,
cellulose derivatives such as
hydroxymethyl cellulose,
hydroxyethyl cellulose,
carboxymetyl cellulose,
methyl cellulose,
ethyl cellulose,
sodium polyacrylate,
polyvinylpyrrolidone,
acrylamide-acrylic ester copolymer,
acrylamide-acrylic ester-methacrylic acid terpolymer,
alkali salts of styrene-maleic anhydride copolymer,
alkali salt of isobutylene-maleic anhydride copolymer,
polyacrylamide,
sodium alginate,
gelatine,
and casein;
emulsions each as polyvinyl acetate,
polyurethane,
polyacrylic acid
polyacrylic ester
vinyl chloride-vinyl acetate copolymer,
polybutylmethacrylate,
ethylene-vinyl acetate copolymer,
latexes such as
styrene-butadiene copolymer,
and styrene-butadiene-acrylic copolymer, In addition, various kinds of conventional heat fusibility materials can be employed depending on the desired purpose (for example, sensitivity improver). However, when heat resistance is required, any such compounds used need to have a fusing point of greater than or equal to 100 degrees C. Suitable examples of heat fusibility materials include, but are not limited to, the following:

fatty acids such as stearic acid,
and behenic acid;
fatty amides such as
stearic amide,
and palmitic acid amid;
fatty acid metallic salts such as
zinc stearate,
aluminum stearate,
calcium stearate,
zinc palmitate
and zinc behenate;
and p-bensylbiphenyl,
m-terphenyl,
p-acethylbiphenyl,
triphenylmethane,
p-benzyloxybenzoate,
β-benzyloxy naphthalene,
phenyl β-naphthoate,
phenyl 1-hydorxy-2-naphthoate,
methly 1-hydorxy-2-naphthoate,
diphenyl carbonate,
guaiacol carbonate,
dibenzyl terephthalate,
dimethyl terephthalate,
1,4-dimethoxynaphthalene,
1,4-diethoxynaphthalene,
1,4-dibenzyloxynaphthalene,
1,2-diphenooxyethane,
1,2-bis(3-methylphenoxy)ethane,
1,2-bis(4-methylphenoxy)ethane,
1,4-diphenoxy-2-buthene
1,2-bis(4-methoxyphenylthio)ethane,
dibenzoylmethane,
1,3-bis(2-vinyloxyethoxy)benzene,
1,4-bis(2-vinyloxyethoxy)benzene,
p-(2-vinyloxyethoxy)biphenyl,
p-aryloxybiphenyl,
p-propargyloxybiphenyl,
dibenzoyloxymethane,
dibenzyl disulfide,
1,1-diphenylethanol,
1,1-diphenylpropanol,
p-(benzyloxy)benzylalcohol,
1,3-phenoxy-2-propanol,
N-octadecylcarbamoyl-p-methoxycarbonylbenzene,
N-octadecylcarbamoylbenzene,
1,2-bis(4-methoxyphenoxy)propane
1,5-bis(4-methoxyphenoxy)-3-oxapentane
1,2-bis(3,4-dimethylphenoxy)ethane
benzyl oxalate,
bis(4-methylbezyl)oxalate, and
bis(4-chlorobezyl)oxalate, As the support for use in the thermosensitive recording material of the present invention, any conventional support material can be used, including but not limited to, high quality paper, supports made from wastepaper pulp (wastepaper pulp is employed more than 50%), synthetic paper, or laminate paper.

In addition, an overcoat layer can be used on the thermosensitive recording layer top, and/or an undercoat layer can be used between the support and the thermosensitive recording layer. The material forming the undercoat layer and/or the overcoat layer can be any conventional material used in such layers, and can employ a binding agent, a filler, and a crosslinking agent to crosslink the layer to the thermosensitive recording layer.

In further embodiments, the thermosensitive recording material of the present invention further comprises an intermediate layer interposed between the support and the thermosensitive recording layer. In such cases, the intermediate layer preferably comprises as the main component plastic minute void particles. Among its functions, this intermediate layer serves as a heat insulating layer, so that the thermal energy supplied by heat-application means such as a thermal head can be used efficiently to improve the thermosensitive recording material.

The void-containing particles for use in the intermediate layer preferably comprise a thermoplastic resin forming a shell of each void particle. Air or gasses are contained in the void of the particles. It is preferable that the average particle diameter of the void-containing particles be in the range from 0.4 μm to 10 μm, more preferably from 1.0 μm to 5.0 μm, most preferably from 2.0 μm to 4.0 μm.

When the particle size of the void-containing particles is within the above range, there is no problem in the production of the intermediate layer because the voidage of the void-containing particles can freely be determined. In addition, the surface smoothness of the intermediate layer is not decreased, although it is prepared by coating a coating liquid comprising such void-containing particles and drying the same, so that the adhesion of the recording layer to the thermal head does not lower, and consequently, the thermosensitivity of the recording material can be prevented from deteriorating. When the above-mentioned advantages are further taken into consideration, it is preferable that the void-containing particles have a narrow size distribution.

It is further preferable that the voidage of the void-containing particles for use in the intermediate layer be greater, with the hollow factor being equal to or more than 30% of the particle volume, more preferably equal to or more than 70% of the particle volume, most preferably from 90–98% of the particle volume. In the present invention, the voidage of the void-containing particles for use in the intermediate layer is expressed by the following formula:

$$\text{Voidage}(\%)=(\text{inner diameter of void-containing particles})/(\text{outer diameter of void-containing particles})\times 100$$

In the present invention, the void-containing particles for use in the intermediate layer are preferably formed from a thermoplastic resin. Suitable thermoplastic resin include, but are not limited to, polystyrene, polyvinylchloride, polyvinylidene chloride, polyvinylacrylate, polyacrylonitrile, polybutadiene or copolymers of any of these resin with one or more different monomers. More preferably the resin is a vinylidenechloride/acrylonitrile copolymer.

When the voidage of the void-containing particles is sufficient, a good heat insulating effect of the intermediate layer can be obtained, so that the thermal energy supplied by the thermal head is prevented from escaping through the substrate of the thermosensitive recording material. As a result, the thermosensitivity-improving effect can be increased.

The material of the present invention can be used in any conventional thermosensitive recording method, including, but not limited to, methods using heat stylus, thermal head, or laser heating.

The material of the present invention can be prepared by any conventional method for preparing thermosensitive recording materials. As an example, the thermosensitive recording layer can be formed on the substrate, followed by application of a protective layer. To form these layers of the exemplary embodiment, the thermosensitive recording layer and protective layer are each spread on the substrate in turn using conventional methods for forming liquid layers, and the resulting layer is dehumidified after each application. Suitable methods for spreading the liquid forming the thermosensitive recording layer and protective layer include, but are not limited to, blade spread methods, air knife spread methods, photogravure spread methods, roll coating spread methods, spray spread methods, dip lotion spread methods, bar spread methods, and low pressure spread methods.

In the present invention, other additives, which are conventionally used for this kind of thermosensitive recording materials, may be used as desired, such as fillers, surfactants, lubricants, and pressure-induced-coloring preventers.

Specific example of such fillers include, but are not limited to, inorganic particulate materials such as calcium carbonate, silica, zinc oxide, titanium oxide, aluminum oxide, zinc hydroxide, barium sulfate, clay, kaolin, talc, and surface-treated calcium carbonate and silica; and organic particles materials such as urea-formaldehyde resins, styrene-methacrylic acid copolymer, polystyrene resin, vinylidene chloride resins, etc.

Specific examples of lubricants include, but are not limited to, higher fatty acids and their metal salts, higher fatty acids amides, higher fatty acid esters, waxes such as animal waxes, vegetable waxes, mineral waxes, petroleum waxes, etc.

Resins suitable for use as an overcoat layer of the present invention include, but are not limited to, resins, preferably water-soluble resins, such as polyvinyl alcohols, cellulosics, amylum and its derivatives, carboxyl group modified polyvinyl alcohols, polyacrylic acids and derivatives thereof, styrene-acrylic acid copolymers and derivatives thereof, poly(meth)acrylamide and derivatives thereof, styrene-acrylic acid-acrylamide copolymers, amino group modified polyvinyl alcohols, epoxy modified polyvinyl alcohols, polyethyleneimines, water-soluble polyesters, water-soluble polyurethanes, isobutylene-maleic anhydride copolymers and derivatives thereof, polyurethanes, acrylate polymers, styrene-acrylate copolymers, epoxide resins, polyvinylidene chloride, polyvinylchloride and derivatives thereof.

Preferably, the resin is a water-soluble polymer such as acetoacetyl modified polyvinyl alcohol.

Examples of suitable fillers to be added to the protective layer include any of those for use in the thermosensitive recording layer, preferably aluminum hydroxide or silica. The quantity of filler added to protective layer is not particularly limited, but is preferably from 30–80% by weight of the whole protective layer, and preferably 40–70% by weight.

The protected layer is preferred to have an adhesion to the thermosensitive recording layer of less than 2.0 g/m$^2$, since adhesion higher than this tends to cause heat transfer to the thermosensitive recording layer from the bottom of the protective layer.

EXAMPLES

Other features of this invention will become apparent in the course of the following description of exemplary embodiments which are given for illustration of the invention and are not intended to be limiting thereof.

Examples 1–14 and Comparative Examples 1–6

(1) Preparation of Dispersions

The following component was ground with a sand mill into an average particle diameter as provided in Table 1 to obtain dispersion A.

The following components were ground with a sand mill into an average particle diameter of about 1.0 μm to obtain dispersions B, C and D.

| Dispersion A | |
|---|---|
| Leuco dye as defined in Table 1: | 20 parts |
| 10% aqueous solution of polyvinyl alcohol: | 20 parts |
| water: | 60 parts |
| **Dispersion B** | |
| 4-hydroxy-4'-allyloxy diphenylsulfone: | 20 parts |
| 10% aqueous solution of polyvinyl alcohol: | 20 parts |
| amorphous silica: | 10 parts |
| water: | 50 parts |
| **Dispersion C** | |
| 4,4'-diallyloxy diphenylsulfone: | 20 parts |
| 10% aqueous solution of polyvinyl alcohol: | 20 parts |
| water: | 60 parts |
| **Dispersion D** | |
| Color developer: (D-90 made by Nippon Soda company) | 20 parts |
| 10% aqueous solution polyvinyl alcohol: | 20 parts |
| water: | 60 parts |

(2) Formation of Thermosensitive Recording Layer

The above components were stirred and dispersed with a rate as defined in Table 1, so that a coating liquid for thermosensitive recording layer was prepared.

(3) Formation of Intermediate Layer

A mixture of the following components was stirred and dispersed, so that coating liquid E and liquid F for intermediate layer were prepared.

| Dispersion E | |
|---|---|
| calcined kaoline: | 20 parts |
| styrene/butadiene copolymer latex: (solid content: 47.5 wt %): | 20 parts |
| water: | 60 parts |

-continued

| Dispersion F | |
|---|---|
| plastic void particle: (Voidage 90%, average particle diameter 3.5 μm, solid content: 40 wt %) | 25 parts |
| styrene/butadiene copolymer latex: (solid content: 47.5 wt %): | 15 parts |
| water: | 60 parts |

(4) Preparation of Thermosensitive Recording Materials:

a. Thermosensitive Recording Materials of Examples 1–12 and Comparative Examples 1–4.

The prepared thermosensitive recording layer coating liquid was coated to the surface of paper with a basis weight of 60 g/m$^2$, serving as a substrate, of the dye component was 0.5 g/m$^2$ on a dry basis, whereby a thermosensitive recording layer was formed on the substrate.

The surface of the thus prepared thermosensitive recording layer was treated by supercalendar.

The kinds of thermosensitive recording layer coating liquid were varied as shown in the Table 1.

b. Thermosensitive Recording Materials of Examples 13–14 and Comparative Examples 5–6.

The prepared intermediate layer coating liquid was coated on a sheet of paper with a basis weight of 60 g/m$^2$, serving as a substrate, at a rate of the intermediate layer component of 3.0 g/m$^2$ on a dry basis, whereby an intermediate layer was formed on a substrate.

The thus prepared thermosensitive recording layer coating liquid was coated on the intermediate layer.

The surface of the thus prepared thermosensitive recording layer was treated by super calendar.

The kinds of thermosensitive recording layer coating liquid and intermediate layer coating liquid were varied as shown in the Table 1.

TABLE 1

| | | Dispersion A | | Dispersion B Amount of | Dispersion C Amount of | Dispersion D Amount of |
|---|---|---|---|---|---|---|
| | Intermediate layer | Leuco dye | Particle size (μm) | addition. (parts) | addition. (parts) | addition. (parts) |
| Ex. 1 | None | Leuco dye 1 | 1.0 | 20 | 0.1 | 20 |
| Ex. 2 | None | Leuco dye 1 | 1.0 | 20 | 0.5 | 20 |
| Ex. 3 | None | Leuco dye 1 | 1.0 | 20 | 2.0 | 20 |
| Ex. 4 | None | Leuco dye 1 | 1.0 | 20 | 3.0 | 20 |
| Ex. 5 | None | Leuco dye 1 | 1.0 | 30 | 0.5 | 10 |
| Ex. 6 | None | Leuco dye 1 | 1.0 | 10 | 0.5 | 30 |
| Ex. 7 | None | Leuco dye 2 | 1.0 | 20 | 0.5 | 20 |
| Ex. 8 | None | Leuco dye 3 | 1.0 | 20 | 0.5 | 20 |
| Ex. 9 | None | Leuco dye 4 | 1.0 | 20 | 0.5 | 20 |

TABLE 1-continued

| | Intermediate layer | Dispersion A Leuco dye | Dispersion A Particle size (μm) | Dispersion B Amount of addition. (parts) | Dispersion C Amount of addition. (parts) | Dispersion D Amount of addition. (parts) |
|---|---|---|---|---|---|---|
| Ex. 10 | None | Leuco dye 1 | 0.8 | 20 | 0.5 | 20 |
| Ex. 11 | None | Leuco dye 1 | 0.4 | 20 | 0.5 | 20 |
| Ex. 12 | None | Leuco dye 1 | 0.2 | 20 | 0.5 | 20 |
| Ex. 13 | Dispersion E | Leuco dye 1 | 1.0 | 20 | 0.5 | 20 |
| Ex. 14 | Dispersion F | Leuco dye 1 | 1.0 | 20 | 0.5 | 20 |
| Comp. Ex. 1 | None | Leuco dye 1 | 1.0 | 20 | None | 20 |
| Comp. Ex. 2 | None | Leuco dye 2 | 1.0 | 20 | None | 20 |
| Comp. Ex. 3 | None | Leuco dye 3 | 1.0 | 20 | None | 20 |
| Comp. Ex. 4 | None | Leuco dye 1 | 0.2 | 20 | None | 20 |
| Comp. Ex. 5 | Dispersion E | Leuco dye 1 | 1.0 | 20 | None | 20 |
| Comp. Ex. 6 | Dispersion F | Leuco dye 1 | 1.0 | 20 | None | 20 |

*Leuco dye 1: 3-dibuthylamino-6-methyl-7-anilinofluoran
*Leuco dye 2: 3-di(n-pentyl)amino-6-methyl-7-anilinofluoran
*Leuco dye 3: 3-(N-ethyl-p-N-toluidino)-6-methyl-7-anilinofluoran,
*Leuco dye 4: 3-(N-ethyl-N-isoamyl)-6-methyl-7-anilinofluoran, The thermosensitive recording materials thus obtained were tested for their thermal coloring performance, heat resistance, and plasticizer resistance to obtain the results shown in Table 2. The test methods were as follows.

Thermal Coloring Performance Test

Using a simulator (manufactured by Ohkura Electric Co., Ltd.), a sample recording material is applied with the energy changed to 0.27 mj/dot, 0.36 mj/dot and 0.45 mj/dot. The density of the image thus developed is measured by Macbeth densitometer RD-914.

Heat Resistance Test

A sample recording material is applied with the energy 0.45 mj/dot. The sample recording material which has been subjected to a recording process in the same manner as in the thermal coloring performance test is allowed to stand at 100° C. for 24 hours. Thereafter, the color densities of the background (BG) and the image (IM) are measured by Macbeth densitometer RD-914.

Plasticizer Resistance Test

A sample recording material is applied with the energy 0.45 mj/dot. Three PVC films are laminated on the sample recording material. Ten pieces of paper are stacked thereon, under the application of a pressure of about 200 g/cm$^2$. After the test sample was allowed to stand at 40° C. in a dry condition for 24 hours, the color densities of the background (BG) and the image (IM) are measured by Macbeth densitometer RD-914.

TABLE 2

| | Thermal Coloring Performance IM 0.27 mj/dot | IM 0.36 mj/dot | IM 0.45 mj/dot | BG | Heat Resistance IM | Heat Resistance BG | Plasticizer Resistance IM | Plasticizer Resistance BG | Plasticizer Resistance Ratio (%) |
|---|---|---|---|---|---|---|---|---|---|
| Ex. 1 | 0.83 | 1.24 | 1.33 | 0.09 | 0.12 | 1.33 | 0.08 | 1.22 | 91.7 |
| Ex. 2 | 0.83 | 1.25 | 1.33 | 0.08 | 0.11 | 1.33 | 0.08 | 1.23 | 92.5 |
| Ex. 3 | 0.85 | 1.26 | 1.33 | 0.08 | 0.12 | 1.33 | 0.08 | 1.21 | 91.0 |
| Ex. 4 | 0.86 | 1.27 | 1.33 | 0.08 | 0.11 | 1.31 | 0.08 | 1.20 | 90.2 |
| Ex. 5 | 0.88 | 1.30 | 1.40 | 0.08 | 0.11 | 1.35 | 0.08 | 1.18 | 84.3 |
| Ex. 6 | 0.78 | 1.22 | 1.33 | 0.08 | 0.11 | 1.33 | 0.08 | 1.30 | 97.7 |
| Ex. 7 | 0.80 | 1.23 | 1.33 | 0.10 | 0.13 | 1.33 | 0.08 | 1.20 | 90.2 |
| Ex. 8 | 0.75 | 0.98 | 1.25 | 0.08 | 0.08 | 1.24 | 0.08 | 1.15 | 92.0 |
| Ex. 9 | 0.85 | 1.28 | 1.33 | 0.10 | 0.15 | 1.33 | 0.08 | 1.25 | 94.0 |
| Ex. 10 | 0.85 | 1.25 | 1.33 | 0.09 | 0.12 | 1.33 | 0.08 | 1.23 | 92.5 |
| Ex. 11 | 0.87 | 1.28 | 1.35 | 0.09 | 0.13 | 1.35 | 0.08 | 1.23 | 91.1 |
| Ex. 12 | 0.90 | 1.29 | 1.35 | 0.10 | 0.14 | 1.35 | 0.1 | 1.24 | 91.9 |
| Ex. 13 | 0.90 | 1.30 | 1.35 | 0.10 | 0.14 | 1.35 | 0.1 | 1.24 | 91.9 |
| Ex. 14 | 1.00 | 1.33 | 1.35 | 0.10 | 0.14 | 1.35 | 0.1 | 1.24 | 91.9 |
| Comp. Ex. 1 | 0.78 | 1.22 | 1.33 | 0.12 | 0.19 | 1.31 | 0.15 | 1.20 | 90.2 |
| Comp. Ex. 2 | 0.78 | 1.22 | 1.33 | 0.13 | 0.20 | 1.31 | 0.15 | 1.18 | 88.7 |
| Comp. Ex. 3 | 0.69 | 0.9 | 1.25 | 0.09 | 0.1 | 1.23 | 0.09 | 1.10 | 88.0 |
| Comp. Ex. 4 | 0.83 | 1.27 | 1.33 | 0.15 | 0.20 | 1.33 | 0.16 | 1.21 | 91.0 |
| Comp. Ex. 5 | 0.85 | 1.27 | 1.33 | 0.12 | 0.19 | 1.33 | 0.15 | 1.21 | 91.0 |
| Comp. Ex. 6 | 0.92 | 1.31 | 1.33 | 0.12 | 0.19 | 1.33 | 0.15 | 1.21 | 91.0 |

As shown in Table 2, the sensitivity has improved when one compares the results of Examples 1 to 4 containing both 4-hydroxy-4'-allyloxy diphenylsulfone and 4,4'-diallyloxy diphenylsulfone to Comparative Example 1 which contains only 4-hydroxy-4'-allyloxy diphenylsulfone as sensitizer.

The results show that the stability of the image, coloring of background, heat resistance and plasticizer have improved for the examples of the present invention. As for Comparative Example 1, the survival rate of an image after test (image stability) as opposed to plasticizer has held a high level, but heat resistance and background coloring are poor.

Examples 5–10 show the effect of ratio of 4-hydroxy-4'-allyloxy diphenylsulfone and general formula (I), and the effect of using different leuco dyes, with each providing good characteristics in measured properties.

Comparative Examples 2 and 3 showed the use of different kinds of dyes in the absence of 4,4'-diallyl diphenylsulfone, as compared to Examples 7 and 8.

Examples 2 and 10–12 show the effect of leuco dye particle size. Sensitivity was found to improve as particle size decreased. Comparative Example 4 used the reduced particle diameter comparable to Example 12, but with no 4,4'-diallyl diphenylsulfone. While sensitivity was good, the coloring of the background was unacceptable.

Examples 13–14 show the use of an intermediate layer (including plastic hollow particles) and gave improved sensitivity as compared to Example 2. Comparative Examples 5 and 6 can be compared to Examples 13–14 respectively. While the Comparative Examples had good sensitivity, the amount of coloring of the background was unacceptable.

As shown by the examples, the present invention is superior with respect to sensitivity, heat resistance, prevention of background coloring and chemical resistance to plasticizers.

What is claimed is:

1. A thermosensitive recording material, comprising a substrate and a thermosensitive recording layer on said substrate, said thermosensitive recording layer comprising a leuco dye, at least two sensitizers and a color developer for inducing color formation in said leuco dye upon application of heat thereto, wherein said at least two sensitizers comprise 4-hydroxy-4'-allyloxy diphenylsulfone and 4,4'-diallyloxy diphenylsulfone, and wherein the color developer is at least one member selected from the group consisting of diphenylsulfone derivatives represented by the following formula (I)

(I)

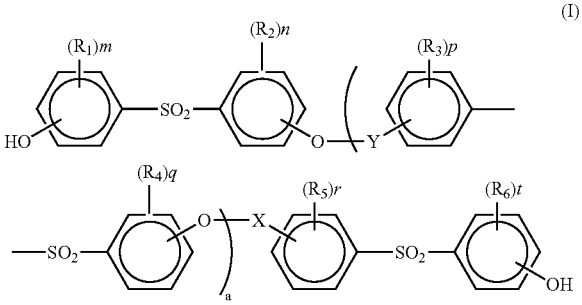

wherein, X and Y are each, independently, a saturated or unsaturated linear or branched hydrocarbon group having 1–12 carbon atoms, which can optionally possess an ether bond, or a group of formula II or III (II)

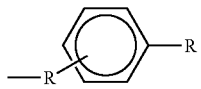

(III)

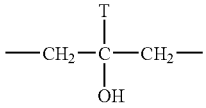

wherein, R7 indicates a methylene group or an ethylene group,

T indicates a hydrogen atom or an alkyl group having 1–4 carbon atoms,

R1–R6 each, independently, indicate a halogen atom, an alkyl group having 1–6 carbon atoms, or an alkenyl group having 2–6 carbon atoms, each of m, n, p, q, r, and t independently indicate an integer of from 0 to 4 and when 2 or larger, R1–R6 can be different, and a is an integer of from 0 to 10.

2. The thermosensitive recording material as claimed in claim 1, wherein the thermosensitive recording layer comprises from 0.5 to 10 parts by weight of 4,4'-diallyloxy diphenylsulfone, relative to 100 parts by weight of 4-hydroxy-4'-allyloxy diphenylsulfone.

3. The thermosensitive recording material as claimed in claim 1, wherein the ratio by weight of 4-hydroxy-4'-allyloxy diphenylsulfone and developer of formula (I) is from 3:7 to 7:3.

4. The thermosensitive recording material as claimed in claim 1, wherein said leuco dye is a member selected from the group consisting of 3-dibutylamino-6-methyl-7-anilinofluoran, 3-di(n-pentyl)amino-6-methyl-7-anilinofluoran, and 3-(N-ethyl-N-p-toluidino)-6-methyl-7-anilinofluoran.

5. The thermosensitive recording material as claimed in claim 1, wherein said leuco dye has an average particle diameter of from 0.1 μm to 0.3 μm.

6. The thermosensitive recording material as claimed in claim 5, wherein said leuco dye has an average particle diameter of from 0.15 to 0.2 μm.

7. The thermosensitive recording material as claimed in claim 1, further comprising an intermediate layer located between said substrate and said thermosensitive recording layer.

8. The thermosensitive recording material as claimed in claim 7, wherein said intermediate layer comprises plastic void-containing particles comprising a thermoplastic resin.

9. The thermosensitive recording material as claimed in claim 8, wherein said void-containing particles have an average particle diameter of from 0.4 μm to 10 μm and a voidage of 30% or more.

10. The thermosensitive recording material as claimed in claim 1, further comprising a printing layer located on said thermosensitive recording layer.

11. The thermosensitive recording material as claimed in claim 1, further comprising a adhesive layer provided on a backside of said substrate, opposite to said thermosensitive recording layer with respect to said substrate.

12. The thermosensitive recording material as claimed in claim 1, further comprising an information memory means.

13. The thermosensitive recording material as claimed in claim 12, wherein the information memory means is a magnetic recording layer which is accommodated at least a part in the material.

14. The thermosensitive recording material as claimed in claim 1, wherein the thermosensitive recording material is in the form of a ticket.

15. The thermosensitive recording material as claimed in claim 1, wherein the thermosensitive recording material is in the form of a point card.

* * * * *